US006002056A

United States Patent [19]

Smith et al.

[11] Patent Number: 6,002,056

[45] Date of Patent: Dec. 14, 1999

[54] COLORLESS PETROLEUM MARKERS

[75] Inventors: Michael J. Smith, Newtown, Pa.; Bharat Desai, Ringwood, N.J.

[73] Assignee: United Color Manufacturing, Inc., Newtown, Pa.

[21] Appl. No.: 09/002,952

[22] Filed: Jan. 5, 1998

Related U.S. Application Data

[63] Continuation of application No. 08/421,327, Apr. 13, 1995, abandoned.

[51] Int. Cl.[6] ..... C10L 1/10; C10L 1/18; C10M 101/02

[52] U.S. Cl. ..... 585/3; 208/12; 208/15; 208/16; 208/17; 208/18; 208/19; 44/350; 44/351; 44/352

[58] Field of Search ..... 208/12, 15, 16, 208/17, 18, 19; 585/3; 44/350, 351, 352; 436/56

[56] References Cited

U.S. PATENT DOCUMENTS

| | | | |
|---|---|---|---|
| 2,046,365 | 7/1936 | Cassidy et al. | 436/141 |
| 2,522,939 | 9/1950 | Gamrath | 260/337 |
| 2,522,940 | 9/1950 | Gamrath | 260/337 |
| 3,883,568 | 5/1975 | Turner et al. | 260/383 |
| 4,209,302 | 6/1980 | Orelup | 44/334 |
| 4,288,402 | 9/1981 | Ellis | 422/61 |
| 4,514,503 | 4/1985 | Orelup | 436/60 |
| 4,735,631 | 4/1988 | Orelup | 44/59 |
| 4,764,290 | 8/1988 | Currey | 508/184 |
| 4,764,474 | 8/1988 | Orelup | 436/111 |
| 4,904,765 | 2/1990 | Derber et al. | 534/573 |
| 4,918,020 | 4/1990 | Nowak | 436/56 |
| 5,145,573 | 9/1992 | Riedel et al. | 208/14 |
| 5,156,653 | 10/1992 | Friswell et al. | 44/328 |
| 5,205,840 | 4/1993 | Friswell et al. | 44/428 |
| 5,266,227 | 11/1993 | Reichelt et al. | 208/12 |
| 5,498,808 | 3/1996 | Smith | 585/3 |
| 5,672,182 | 9/1997 | Smith | 44/349 |

FOREIGN PATENT DOCUMENTS

| | | |
|---|---|---|
| 0543057 | 5/1993 | European Pat. Off. . |
| 54-049198 | of 1979 | Japan . |
| 361310 | 11/1931 | United Kingdom . |

*Primary Examiner*—Walter D. Griffin
*Attorney, Agent, or Firm*—Andrea G. Reister; Howrey & Simon

[57] ABSTRACT

Petroleum products are marked with a marker such as thymolphthalein or cresolphthalein. When the marked petroleum products are contacted with a developing reagent, a color develops.

41 Claims, No Drawings

COLORLESS PETROLEUM MARKERS

This application is a continuation of application Ser. No. 08/421,327, filed Apr. 13, 1995, now abandoned.

BACKGROUND OF THE INVENTION

The present invention relates to colorless or near colorless compounds useful for marking or tagging petroleum fuels. It also pertains to a reagent useful in developing color of base-extractable markers. It also relates to a method for bleaching the color of the developed marker thereby restoring the fuel to its original appearance so that it may be combined with undeveloped marked fuel, avoiding the necessity of disposing separately of a potentially hazardous marker extract, which is customary in the prior art.

A marker is a substance which can be used to tag petroleum products for subsequent detection and is ordinarily colorless in the petroleum product. The marker is dissolved in a liquid to be identified, then subsequently detected by performing a simple physical or chemical test on the tagged liquid. Markers are sometimes required by government to ensure that the appropriate tax has been paid on particular grades of fuel. Oil companies also mark their products to help identify those who have diluted or altered their products. These companies often go to great expense to make sure their branded petroleum products meet certain specifications, for example, volatility and octane number, as well as to provide their petroleum products with effective additive packages containing detergents and other components. Consumers rely upon the product names and quality designations to assure that the product being purchased is the quality desired.

It is possible for unscrupulous gasoline dealers to increase profits by selling an inferior product at the price consumers are willing to pay for a high quality branded or designated product. Higher profits can also be made simply by diluting the branded product with an inferior product. Policing dealers who substitute one product for another or blend branded products with inferior products is difficult in the case of gasoline because the blended products will qualitatively display the presence of each component in the branded products. The key additives made to the branded products are generally present in such low levels that quantitative analysis to detect dilution with an inferior product is very difficult, time consuming and expensive.

Marker systems for fuels and other petroleum products have been suggested but various drawbacks have existed which have hindered their effectiveness. Many, for instance, lose their effectiveness over time, making them too difficult to detect after prolonged storage. In addition, reagents used to develop the color of markers often are difficult to handle or present disposal problems. Furthermore, some marking agents partition into water. This causes the markers to lose effectiveness when storage occurs in tanks that contain some water. The fuels and other petroleum products are themselves substantially free of water.

The compositions of the present invention contain compounds conventionally described as hydroxyphthaleins. Some of these are well established as visual pH indicators in the field of laboratory acid/base titrimetry. Some have also been proposed as suitable for some biomedical applications, however their use as marker or tagging substances for Petroleum fuels and additives is unique.

A similar compound that has been considered for use as a marker is Phenolphthalein. Its use was proposed in 1994 as a fuel marker by the U.S. Environmental Protection Agency and subjected to an oil refinery field trial under their auspices. The trial was unsuccessful, because phenolphthalein lacks adequate solubility in petroleum fuels at the concentration required as a marker. This caused the phenolphthalein to partially crystallize from the fuel, resulting in undermarking and contamination of refinery equipment, pipelines, etc. Phenolphthalein is also significantly soluble in water and it partially extracted from the marked fuel into the water layer which frequently accumulates at the bottom of fuel storage tanks, thus rendering it useless as a quantitative fuel marker. Furthermore, phenolphthalein is particularly sensitive to the alkalinity of the extraction or development reagent. With an aqueous extractant having a pH of less than 10.5, extraction is slow and incomplete, however above about pH 11 phenolphthalein rapidly forms a colorless trianion. These defects do not apply to the substances of the current invention.

Markers of the present invention possess increased petroleum fuel solubility and decreased solubility in neutral water. Their susceptibility to trianion formation and partial decolorization of the colored dianion in the presence of strong bases is also minimized. These advantages appear to occur due to the presence of an alkyl or alkoxy group adjacent to the ionizable hydroxy group of the markers of this invention.

The present invention provides markers which are invisible in liquid petroleum products at an effective level of use but that provide a distinctive color when extracted from the petroleum product with an appropriate developing reagent. The reagents used to develop the color are themselves easy to use, handle and dispose of.

The fact that the markers of the present invention impart no visible color to petroleum fuels at an effective dosage level makes them suitable for marking a wide range of petroleum products. Currently, for instance, they may be useful for marking or tagging on-road, low sulfur, diesel fuel. A regulation issued by the Federal Government precludes the addition to such fuel of any dye or dye related substance that will impart visible color to the fuel at an effective treatment rate. This regulation prevents the use of variously intensely colored substances proposed in the prior art as petroleum fuel markers, for instance those disclosed in U.S. Pat. Nos. 5,156,653; 5,205,840; 4,764,474; and 4,735,631. The disclosures of each of these patents is incorporated herein by reference.

SUMMARY OF THE INVENTION

The present invention includes marker compositions and compositions including a liquid petroleum product and a detectable level of marker which is a derivative of 1(3H) iso benzofuranone:

I

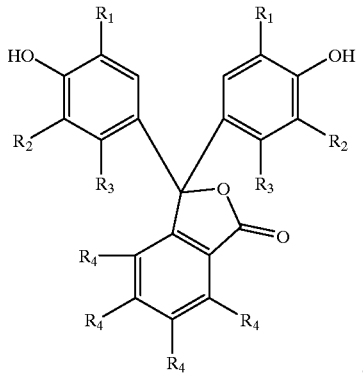

Wherein $R_1$ is an alkyl or alkoxy group containing 1 to 8 carbon atoms; $R_2$ and $R_3$ are hydrogen, alkyl or alkoxy groups. $R_4$is any combination of bromine, chlorine, or hydrogen.

Alternatively, carbon atoms $R_2$ and $R_3$ may form part of a naphthalene ring system as illustrated below:

II

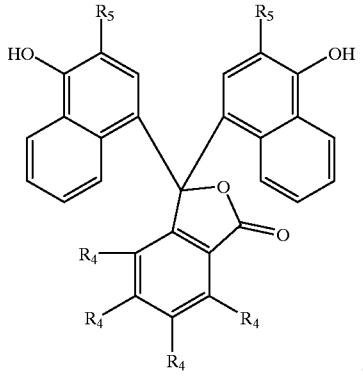

Wherein $R_1$–$R_4$ are the same as described above and $R_5$ is a hydrogen atom, alkyl or alkoxy group containing 1–8 carbon atoms.

The present invention also includes a method of marking a petroleum product comprising adding to the liquid petroleum product a detectable level of a marker selected from the group consisting of:

I

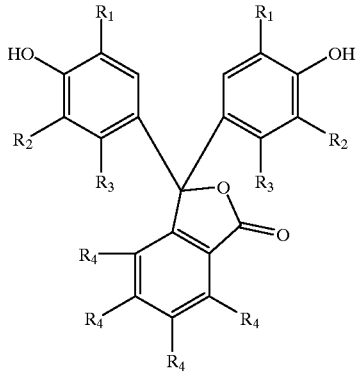

-continued and

II

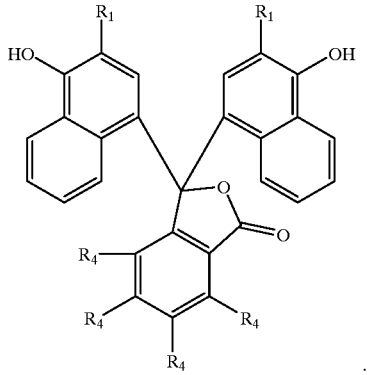

Where $R_1$–$R_5$ are the same as described above.

The present invention is also a method of identifying a liquid petroleum product by obtaining a sample of liquid petroleum product containing a detectable level of a marker described above and adding a developing reagent to the sample to develop color.

The present invention also includes a method for identifying a petroleum product by obtaining a sample of petroleum product containing a detectable level of Thymolphthalein marker, adding a developing reagent to the sample, and extracting the marker into an extraction medium.

The present invention also includes a solution for marking petroleum products comprising a marker, as described above, and a solvent for the marker that is miscible in the petroleum product.

DETAILED DESCRIPTION OF THE INVENTION

The markers of the present invention may be added to any liquid petroleum product such as fuels, lube oils and greases. Examples of liquid petroleum products of the present invention are gasoline, diesel fuel, fuel oil, Kerosene and lamp oil. The marker, when developed, is detectable visually over a wide range of concentrations but preferably is present at a level of at least about 0.5 ppm to 5 ppm and most preferably at a level of about 0.5 to about 100 ppm.

Because the markers are essentially colorless in petroleum products, their presence is detected by reacting them with a developer or developing reagent. For use in the present invention, the developing reagent must contain a strong base such as an alkali metal hydroxide, or most preferably a quaternary ammonium hydroxide. The pH of the developing reagent is about 10 to about 14 and preferably about 11 to about 13. Once in contact with the suggested bases it appears that the marker ionizes with the prompt formation of an intensely colored dianion. The intensity of the colored marker permits easy visual detection. Providing that only a qualitative indication of the presence of the marker is required, the now colored, "developed", fuel may be returned to its source. In this way, the developing reagent and marker are burned or used up with the product so that no potentially hazardous waste from, say, a roadside test, accumulates for disposal. Prior to returning the marker-developed, fuel sample to its original source, the color of the developed market may be destroyed by the addition of a fuel miscible acid, preferably an organic carboxylic acid such as oleic or iso stearic acid. In this way fuel at the original source will not be color contaminated by the addition of "developed" fuel which may contain active, unreacted developer.

In the event that the color of the developed marker is obscured by other coloring agents in the petroleum product, the colored marker may be rendered visible by extraction from the developed fuel into an extraction medium. The extraction medium and the liquid petroleum fuel may be combined in a ratio of about 1 to about 17 by volume. This may be accomplished by addition of water alone as an extraction medium so the sample, but use of mixtures of water and a phase separation enhancer such as aliphatic alcohols, aromatic alcohols, glycols, or glycol ethers are preferred. Use of a phase separation enhancer promotes an easier separation of the aqueous and organic phases. Additionally, other substances, for example pH buffer salts, may be present in the extractant phase to stabilize the colored dianion or marker. Preferred extraction medium mixtures may also contain quaternary ammonium hydroxide compounds to provide a simple method of developing color by forming the dianion or marker and a suitable medium into which the developed marker can be immediately extracted. Other strong bases, of course, may be used, particularly alkali metal hydroxides.

The extracted phase may be examined visually for a qualitative determination of the markers presence. Alternatively, the extracted marker may be detected and quantified by visible light absorption spectrophotometry. An advantage of the extraction technique is that it affords the opportunity to concentrate the marker from the petroleum fuel, thereby increasing the sensitivity of the test procedures.

The markers of the present invention are represented by the following structures:

I

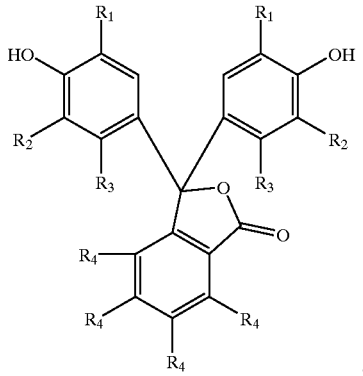

Wherein $R_1$ is an alkyl or alkoxy group containing 1 to 8 carbon atoms; $R_2$ and $R_3$ are hydrogen, alkyl or alkoxy groups. $R_4$ is any combination of bromine, chlorine, or hydrogen. The total number of alkyl carbon atoms in $R_1$, $R_2$ and $R_3$ combined preferably does not exceed 12.

Alternatively, carbon atoms $R_2$ and $R_3$ may form part of a naphthalene ring system as illustrated below:

II

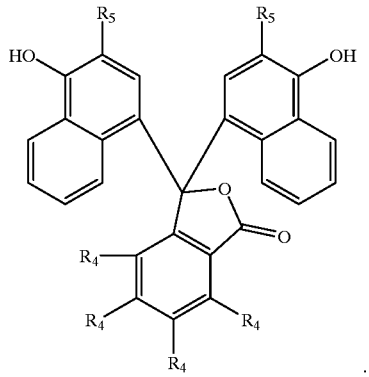

Wherein $R_5$ is a hydrogen atom, alkyl or alkoxy group containing 1–8 carbon atoms.

Marker compounds of the present invention may be synthesized by any of a number of conventional methods involving the condensation of one molar equivalent of a 1,2 Phthalic acid, or preferably its anhydride, with two molar equivalents of a 2 alkylphenol or a 1 naphthol, where the carbon atom at the 4 position with respect to the aromatic hydroxy group in the 1 position is available for reaction. The actual condensation reaction is brought about by the action of heat, preferably in the presence of a dehydrating acid like orthophosphoric acid, sulfuric acid or methane sulfonic acid or by a metal halide of the type reactive in Friedel-Crafts synthesis especially aluminum chloride, stannic chloride or zinc chloride. The last named catalyst is particularly effective when employed in the synthetic techniques recommended by Gamrath in U.S. Pat. Nos. 2,522,939 and 2,522,940 for the synthesis of Phenolphthalein, the disclosures of each of which are incorporated herein by reference in their entirety. A combination of dehydrating acid and Friedel-Crafts metal halide is also satisfactory.

The marker compounds may be used in dry form as a powder or crystals or as a liquid solution concentrate. Liquid forms are usually preferred for handling reasons.

To provide a liquid concentrate solution containing marker, the marker is dissolved or diluted into a solvent to create a non-aqueous solution that has a high solubility in the petroleum products. Suitable solvents for use with liquid petroleum products include, for instance, aromatic hydrocarbons, especially alkyl benzenes, such as xylene, and naphthalenes; aromatic alcohols, especially Benzyl alcohol and Phenolglycolether; and aprotic solvents like formnamide, N,N diimethylformamide, N,N dimethyl acetamide or 1 Methyl pyrrolidone. These solvents may be used singly, or advantageously, in blends. When combined with appropriate solvents, markers, of the present invention, form stable liquid compositions that dissolve readily into petroleum products. The availability of marker compounds as stable, free-flowing liquids makes them much more attractive to the petroleum industry than dry or solid products primarily because liquids are easier to handle. Dry or solid forms of markers can, however, be used directly.

For example, a liquid concentrate solution may be generally comprised of about 5–50% by weight marker and about 50–95% by weight solvent. Preferable ranges for the solution may be 15–25% (wt) marker and 75–85% (wt) solvent. As stated above, suitable solvents include both aprotic solvents and aromatic solvents. The amount of aprotic solvents included in the solution depends upon the amount of marker added, the viscosity of the solution, the relative cost of the aprotic solvent used, as well as other factors known in the art. The aromatic solvent or cosolvents used in a particular liquid concentrate solution will be selected based upon the type of petroleum product that is to be marked. For instance, a more volatile solvent will be chosen to mark gasoline products and a less volatile solvent will be used in liquid concentrate solutions used to mark and identify diesel or home heating oil products.

One specific form of marker that may be used herein is Thymolphthalein. Its structure is represented by the following formula:

III

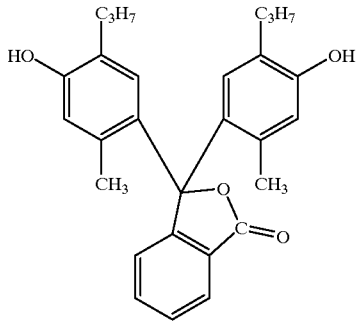

It may be formed by condensation of one molar equivalent of phthalic acid or anhydride with two molar equivalents of 2 isopropyl 5 methyl phenol (Thymol), in the presence of dehydrating agent such as phosphoric acid, stannic chloride or zinc chloride. The compound is prepared in good yields by the procedures recommended for Phenolphthalein as disclosed in U.S. Pat. No. 2,522,939, the entire disclosure of which is expressly incorporated herein by reference.

Thymolphthalein may be used in dry form (usually powder or crystals) or as a liquid solution concentrate. Liquid concentrates may be prepared by combining the marker with a solvent which is completely miscible with the petroleum product to be marked. Because the direct solubility of Thymolphthalein in straight petroleum hydrocarbons is somewhat limited, it is especially advantageous to include in the solvent composition an aprotic solvent, particularly 1 Methyl 2 Pyrrolidone which greatly increases the solubility of the Thymolphthalein in the hydrocarbon. Other useful solvents for combination with Thymolphthalein include suitable aromatic hydrocarbons, especially alkyl benzenes, such as xylene, and naphthalenes; aromatic alcohols, particularly Benzyl alcohol and Phenolglycolether; and other aprotic solvents, particularly formamide, N,N dimethylformamide and N,N dimethylacetamide. For instance, a composition containing Thymolphthalein may include about 5–50% by weight marker, about 5–50% by weight aprotic solvents, and about 0–90% by weight aromatic solvents. A liquid concentrate solution using Thymolphthalein as a marker comprised of about 10–30% by weight marker, about 10–40% by weight aprotic solvents, and about 30–80% aromatic solvents is particularly useful as a composition that dissolves readily in most liquid petroleum products and is stable in the product; that is, it remains dissolved in the petroleum product for a commercially significant period of time.

Particularly when combined with appropriate solvents, Thymolphthalein and other compounds of the present invention form stable liquid compositions that dissolve readily into petroleum products. The availability of the marker compound as a stable, free-flowing liquid makes it much more attractive to the petroleum industry than dry or solid products primarily because liquids are easier to handle. Dry or solid forms of markers, however, could be used.

The following examples serve to illustrate, but do not limit the scope, of the invention.

EXAMPLE 1

A stirred one liter glass flask is charged with 400 grams of anhydrous methane sulphonic acid. 200 grams of 2 isopropyl 5 methyl phenol (Thymol) is then added followed by 110 grams of phthalic anhydride. The reaction mixture is heated to 85° C. and maintained at this temperature for 5 hours. The flask contents are then drowned into 1,500 milliliters of well stirred cold water when the product precipitates as a red granular solid in the form of its oxonium salt. A sufficient amount of a 40% solution of sodium hydroxide is added to the stirred mixture to raise the pH to 4. This hydrolizes the oxonium salt and the product is converted to a light yellowish orange solid. The product is recovered by filtration, washed with cold water and then dried at 70° C. 256 grams of product is recovered with an active Thymolphthalein content of 76.7%. This is 68.5% of the expected amount.

EXAMPLE 2

The above synthetic procedure is repeated except that 40 grams of anhydrous aluminum chloride is added after the phthalic anhydride. The reaction mixture is heated to 85–90° C. and maintained for 4 hours during which time there is a copious evolution of hydrochloric acid gas. The reaction mixture is then drowned into cold water and neutralized to pH2 with sodium hydroxide. The precipitated product is recovered by filtration, water washed and dried. A yield of 235 grams of product, less colored than that obtained in example 1, is recovered. It contains 84.2% active Thymolphthalein, equivalent to about 74.9% of the theoretically expected amount.

EXAMPLE 3

A stirred one liter flask is charged with 500 grams of anhydrous methane sulphonic acid, 110 grams of Phthalic anhydride and 144 grams of ortho cresol. The mixture is warmed to 40° C. and 40 grams of anhydrous aluminum chloride added. The mixture is heated to 85° C. and maintained for 4 hours. It is then drowned into cold water which is then adjusted to pH2 with aqueous sodium hydroxide solution. The precipitated product is recovered by filtration, water washed and dried. 160 grams of a greyish-white solid is recovered which has an ortho cresolphthalein content of 98.2%. This is equivalent to 68.1% of the theoretically expected yield.

EXAMPLE 4

The procedure of Example 3 is repeated except the 144 grams of ortho cresol is replaced by 235 grams of 2 cychohexyl phenol. The synthesis yielded 215.8 grams of creamy white solid with an assay of 79.5% which is 65% of the theoretically expected amount.

EXAMPLE 5

The procedure of Example 1 is repeated except that the 200 grams of 2 isopropyl 5 methylphenol is replaced by 195 grams of 1 Naphthol (98% pure). 255 grams of crude product is recovered.

EXAMPLE 6

20 grams of Thymolphthalein is stirred into 50 grams of mixed methyl naphthalenes sold as Exxon Aromatic® 200 solvent and 30 grams of 1 Methylpyrrolidone is added. The mixture is heated to 40° C. until all of the ester has dissolved, the hot solution is filtered and bottled. The solution shows no tendency to crystallize upon prolonged storage at 0° F.

EXAMPLE 7

50 grams of Thymolphthalein is dissolved in 50 grams of 1 Methylpyrrolidone by gentle heating. The filtered solution has excellent storage stability at 0° F.

EXAMPLE 8

500 milligrams of the solution obtained in Example 6 is dissolved in toluene and made to 100 mls in a graduated flask. 1.0 ml of this solution is pipetted into 100 mls of premium gasoline (purchased retail), already colored red with 3 parts per million of Unisol Liquid Red B (a brand name used by United Color Mfg. for a dye whose principal color component is C.I. Solvent Red 164), and contained in a separatory funnel. The gasoline sample contains the equivalent of 10 ppm Thymolphthalein as a marker. 5 mls of an aqueous solution containing 15% sodium chloride and sufficient potassium hydroxide to raise its pH to 12.0, is now added to the marked gasoline in the separatory funnel. The two phases are shaken together for two to three minutes, then allowed to separate. The upper gasoline phase retains its light red appearance but the lower aqueous phase now has a strong blue color. This phase may be separated and the quantity of blue dye measured by spectrophotometry at its wavelength of maximum absorbance which occurs at approximately 590 nanometers.

EXAMPLE 9

The procedure of Example 8 is repeated with distilled, almost water white, gasoline except that 20 ppm of Thymolphthalein, as solution in toluene, is added. The presence of the marker causes no visible change in appearance of the gasoline.

EXAMPLE 10

Five milliliters of marked colored gasoline prepared as in Example 8 is mixed with 95 milliliters of unmarked gasoline. This mixture is again subjected to the same extraction procedure with alkaline salt water as in Example 8. Even with this much-diminished concentration of marker the aqueous extract is noticeably blue and again the quantity of dye may be measured instrumentally, if desired, by comparison with a calibration standard.

EXAMPLE 11

A 50 milliliter sample of red dyed gasoline marked with 10 parts per million of Thymolphthalein has added to it 5 milliliters of a developer composition, which is a 10% solution of tetrabutyl ammonium hydroxide dissolved in ethyleneglycol mono n-propyl ether. After the mixture is shaken for a few seconds it acquires a distinct blue appearance, clearly visible above the red background color of the gasoline. If only a qualitative detection of the marker in the gasoline is required, the developed, marked gasoline may be returned to the fuel source; thus avoiding a separate potentially hazardous waste disposal problem. If a quantitative determination of the marker is needed or desired, this can be accomplished by direct spectrophotometry, depending on the level of background interference from other components in the fuel. Otherwise, a 5 milliliter aliquot of a 10% solution of sodium chloride in distilled water may be added to the developed, marked fuel. When the mixture is shaken together for a short time the blue marker dianion will extract into a lower aqueous phase which may be separated and quantified as in Example 8.

EXAMPLE 12

100 milliliters of the gasoline solution containing 15 parts per million of Thymolphthalein has added to it 1 milliliter of a 10% solution of tetra n-butyl ammonium hydroxide in ethylene glycol mono n-propyl ether. The mixture almost immediately develops a blue color denoting the presence of the Thymolphthalein marker. An addition of 1 milliliter of iso stearic acid is now made which causes the blue color of the Thymolphthalein marker to disappear and restores the gasoline to its original appearance. The sample may then be returned to its original source.

EXAMPLE 13

50 milliliters of diesel fuel containing 5 parts per million each of Thymolphthalein and the di-n-butyl ester of Fluorescein as described in U.S. patent application Ser. No. 08/375,310, filed Jan. 20, 1995, (the disclosure of which is incorporated herein by reference) is placed in a clear glass 100 ml bottle and has added to it one milliliter of a 10% solution of tetra n-butyl ammonium hydroxide in ethylene glycol mono n-propyl ether. The mixture rapidly develops an appearance which is fluorescent blue by reflected light and fluorescent green by transmitted light, very distinct from the color of unmarked fuel. Part of the solution may be placed in a spectrophotometer cell and the relative intensities of the Fluorescein and Thymolphthalein dianions measured at their wavelengths of maximum absorbance which occur around 490 and 600 nanometers respectively. Alternatively the spectrophotometry may be carried out on an aqueous saline extract of the markers as described in Example 8. If this option is not pursued the developed, unextracted marked fuel may have added to it an aliquot of acid which neutralizes the marker and eliminates the fuel color due to the developed marker. The fuel may then be returned to its original source.

EXAMPLES 14–21

By employing essentially similar synthesis reaction techniques to those illustrated in Examples 1 through 5, followed by the development technique of Example 8, the following further products were made and evaluated.

| Example | Acid Anhydride | Phenol | Visual Color | Dominant Wavelength of Absorption |
|---|---|---|---|---|
| 14 | Phthalic | 2 secbutyl phenol. | Bright Purple | 571.5 nm. |
| 15 | Phthalic | 2,6 di isopropyl phenol. | Bright Reddish Blue | 592.5 nm. |
| 16 | Phthalic | 2,6 disecbutyl phenol | Bright Royal Blue | 593.5 nm. |
| 17 | Phthalic | 2 tertiary butyl 5 methylphenol | Reddish Blue | 597 nm. |

-continued

| Example | Acid Anhydride | Phenol | Visual Color | Dominant Wavelength of Absorption |
|---|---|---|---|---|
| 18 | Phthalic | 2 n-propoxy phenol | Reddish Blue | 597 nm. |
| 19 | 2, 3, 4, 5 tetrachloro Phthalic | 2 isopropyl 5 methyl phenol | Pure Blue | 621.5 nm. |
| 20 | Phthalic | 1 Naphthol | Turquoise Blue | 655 nm. |
| 21 | 2, 3, 4, 5 tetrachloro phthalic | 1 naphthol | Neptune Blue | 658.5 nm. |

It should be noted that due to solvatotropism the above stated dominant wavelengths of absorption may change somewhat under different conditions of observation.

Applicant's invention has been described with reference to preferred embodiments. Numerous modifications to the described invention may be made without departing from the scope of the invention.

What is claimed is:

1. A composition comprising a petroleum fuel and a detectable level of a marker selected from the group consisting of formula I and formula II:

I.

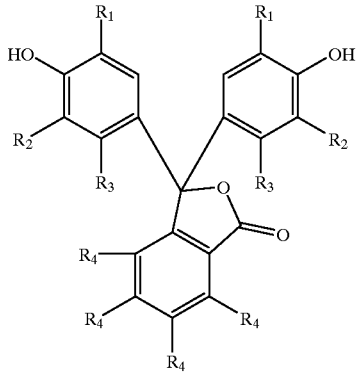

II.

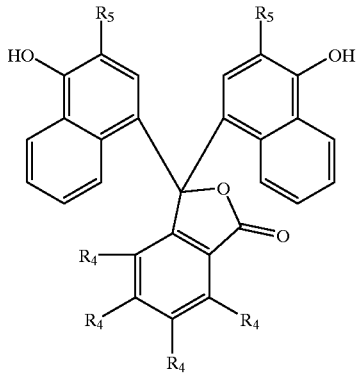

wherein $R_1$ is an alkyl or alkoxy group containing 1 to 8 carbon atoms; $R_2$ and $R_3$ are hydrogen, alkyl or alkoxy groups; $R_4$ is hydrogen, chlorine or bromine; and $R_5$ is a hydrogen atom or alkyl or alkoxy group containing 1 to 8 carbon atoms, and wherein said marker develops a color upon contact with a developing reagent.

2. The composition of claim 1, wherein the petroleum fuel is selected from the group consisting of gasoline, diesel fuel, fuel oil, kerosene, and lamp oil.

3. The composition of claim 1, wherein the marker is present in the petroleum fuel at a level of at least about 0.5 ppm.

4. The composition of claim 1, wherein the marker is present in the petroleum fuel at a level of from at least about 5 ppm to about 100 ppm.

5. The composition of claim 1, wherein said marker is:

III

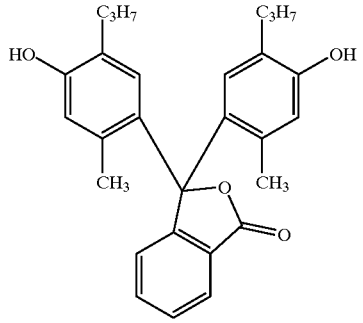

6. The composition of claim 1, wherein the total number of alkyl carbon atoms in $R_1$, $R_2$, and $R_3$ combined does not exceed 12.

7. A method of marking a petroleum fuel comprising adding to the petroleum fuel a detectable level of a marker selected from the group consisting of formula I and formula II:

I.

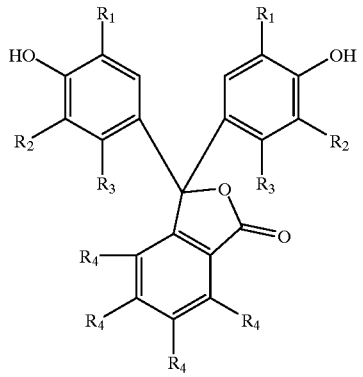

II.

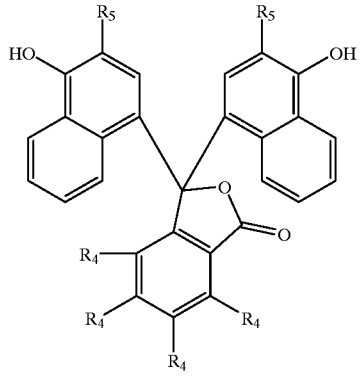

wherein $R_1$ is an alkyl or alkoxy group containing 1 to 8 carbon atoms; $R_2$ and $R_3$ are hydrogen, alkyl or alkoxy groups; $R_4$ is hydrogen, chlorine or bromine; and $R_5$ is a hydrogen atom or alkyl or alkoxy group containing 1 to 8 carbon atoms, and wherein the marker develops a color upon contact with a developing reagent.

8. The method of claim 7, wherein the petroleum fuel is selected from the group consisting of gasoline, diesel fuel, fuel oil, kerosene, and lamp oil.

9. The method of claim 7, wherein at least about 0.5 ppm of marker is added to the petroleum fuel.

10. The method of claim 7, wherein at least about 5 ppm to about 100 ppm of marker is added to the petroleum fuel.

11. The method of claim 7, wherein the marker is in liquid form when added to the petroleum fuel.

12. A method of identifying a petroleum fuel containing a marker comprising:

a) obtaining a sample of the petroleum fuel containing a detectable level of a marker selected from the group consisting of formula I and formula II:

I.

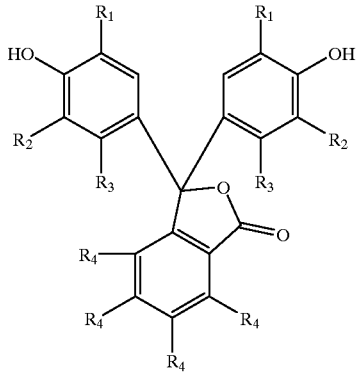

II.

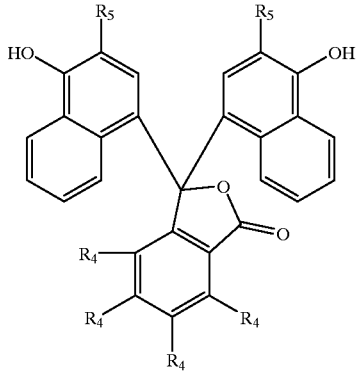

wherein $R_1$ is an alkyl or alkoxy group containing 1 to 8 carbon atoms; $R_2$ and $R_3$ are hydrogen, alkyl or alkoxy groups; $R_4$ is hydrogen, chlorine or bromine; and $R_5$ is a hydrogen atom or alkyl or alkoxy group containing 1 to 8 carbon atoms, and b) adding a developing reagent to said sample to develop color.

13. The method of claim 12, wherein the petroleum fuel is selected from the group consisting of gasoline, diesel fuel, fuel oil, kerosene, and lamp oil.

14. The method of claim 12, wherein color is developed by base hydrolysis to produce a colored dianion.

15. The method of claim 12, wherein the developing reagent has a pH of about 10 to about 14.

16. The method of claim 12, wherein the developing reagent has a pH of about 11 to about 13.

17. The method of claim 12, wherein the developing reagent is a base selected from the group consisting of alkali metal hydroxides and quaternary ammonium hydroxides.

18. The method of claim 12, further comprising the step of neutralizing the colored developed marker by adding an acid to restore the fuel to its appearance prior to identification.

19. The method of claim 12, wherein the developing reagent is added to the sample as part of an extraction medium.

20. The method of claim 19, wherein the extraction medium and the petroleum fuel are combined in a ratio of about 1 to about 17 by volume.

21. The method of claim 19, wherein the extraction medium is a mixture comprising water and a phase separation enhancer selected from the group consisting of aliphatic alcohols, aromatic alcohols, glycols, or glycol ethers.

22. The method of claim 21, wherein the mixture further comprises a quaternary ammonium hydroxide compound.

23. A method for identifying a petroleum fuel comprising:

a) obtaining a sample of petroleum fuel containing detectable level of thymolphthalein marker, b) extractingasaid marker into an extraction medium, and c) adding a developing reagent to said marker.

24. The method of claim 23, wherein the petroleum fuel is selected from the group consisting of gasoline, diesel fuel, fuel oil, kerosene and lamp oil.

25. A solution for marking petroleum fuels, comprising by weight:

a) 5–50% marker, wherein said marker is a marker selected from the group consisting of formula I and formula II:

I.

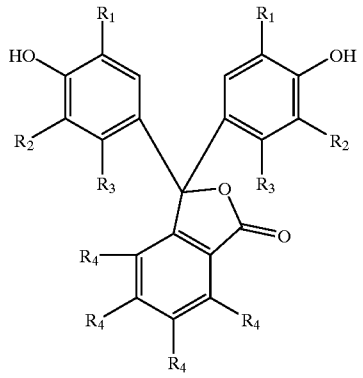

II.

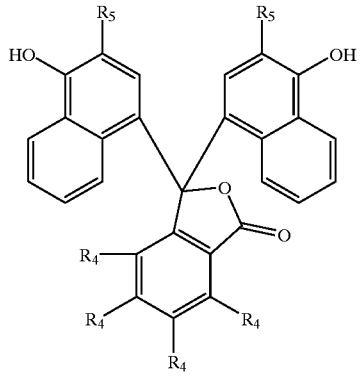

wherein $R_1$ is an alkyl or alkoxy group containing 1 to 8 carbon atoms; $R_2$ and $R_3$ are hydrogen, alkyl or alkoxy groups; $R_4$ is hydrogen, chlorine or bromine; and $R_5$ is a hydrogen atom or alkyl or alkoxy group containing 1 to 8 carbon atoms, and b) 30–80% aromatic solvent, wherein the aromatic solvent is selected from the group consisting of aromatic hydrocarbons and aromatic alcohols; and c) 5–50% aprotic solvents;

wherein the aromatic and aprotic solvents are miscible in the petroleum fuel.

26. The solution of claim 25, wherein the solution comprises by weight about 10–30% marker, about 30–80% aromatic solvents, and about 10–40% aprotic solvents.

27. The solution of claim 25, wherein the aprotic solvent is selected from the group consisting of 1-methylpyrrolidone, NN-dimethylformamide, and NN-dimethylacetamide.

28. The solution of claim 25, wherein the solution comprises, by weight, about 20% thymolphthalein, about 50% aromatic solvents, and about 30% 1-methylpyrrolidone.

29. A composition comprising:

a liquid petroleum product selected from the group consisting of a lube oil or grease, wherein the petroleum product is substantially free of water, and a detectable level of a marker selected from the group consisting of formula I and formula II:

I.

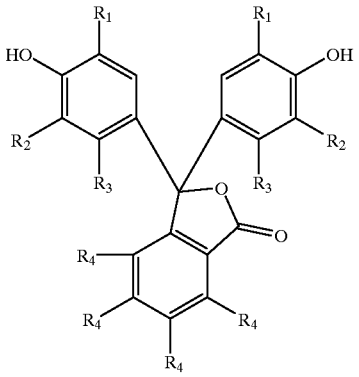

II.

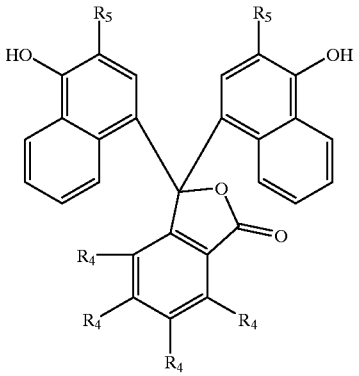

wherein $R_1$ is an alkyl or alkoxy group containing 1 to 8 carbon atoms; $R_2$ and $R_3$ are hydrogen, alkyl or alkoxy groups; $R_4$ is hydrogen, chlorine or bromine; and $R_5$ is a hydrogen atom or alkyl or alkoxy group containing 1 to 8 carbon atoms, wherein said marker develops a color upon contact with a developing reagent.

30. The composition of claim 29, further comprising an aprotic solvent.

31. The composition of claim 30, wherein the aprotic solvent is selected from the group consisting of 1-methylpyrrolidone, NN-dimethylformamide, and NN-dimethylacetamide.

32. The composition of claim 30, wherein the aprotic solvent is 1-methylpyrrolidone.

33. The composition of claim 29, wherein the liquid petroleum product is a lube oil.

34. The composition of claim 29, wherein the liquid petroleum product is a grease.

35. A method of marking a liquid petroleum product which is a lube oil or grease comprising forming a composition by adding to the liquid petroleum product a detectable level of a marker selected from the group consisting of formula I and formula II:

I.

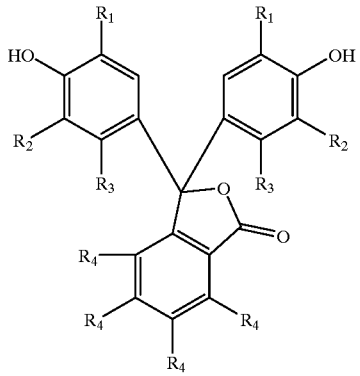

II.

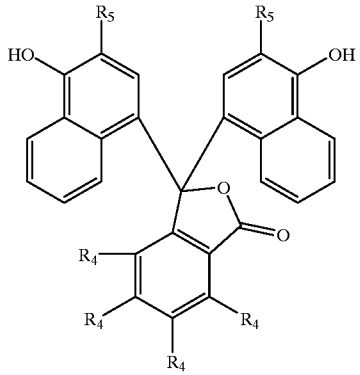

wherein $R_1$ is an alkyl or alkoxy group containing 1 to 8 carbon atoms; $R_2$ and $R_3$ are hydrogen, alkyl or alkoxy groups; $R_4$ is hydrogen, chlorine or bromine; and $R_5$ is a hydrogen atom or alkyl or alkoxy group containing 1 to 8 carbon atoms, wherein said marker develops a color upon contact with a developing reagent, wherein said marker develops a color upon contact with a developing reagent, and wherein the composition is substantially free of water.

36. The method of claim 35, wherein the liquid petroleum product is a lube oil.

37. The method of claim 35, wherein the liquid petroleum product is a grease.

38. A method of identifying a petroleum product which is a lube oil or grease containing a marker comprising:

a) obtaining a sample of the petroleum product containing a detectable level of a marker selected from the group consisting of formula I and formula II:

I.

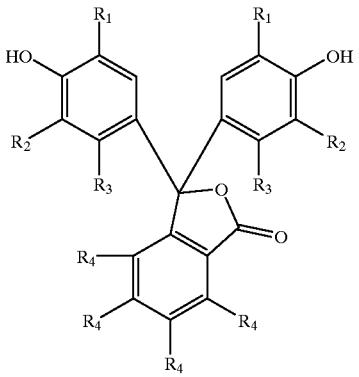

-continued

II.

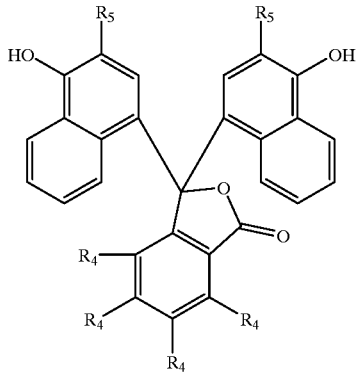

wherein $R_1$ is an alkyl or alkoxy group containing 1 to 8 carbon atoms; $R_2$ and $R_3$ are hydrogen, alkyl or alkoxy groups; $R_4$ is hydrogen, chlorine or bromine; and $R_5$ is a hydrogen atom or alkyl or alkoxy group containing 1 to 8 carbon atoms, and wherein the petroleum product is substantially free of water; and b) adding a developing reagent to said sample to develop color.

39. The method of claim 38, wherein the petroleum product is a lube oil.

40. The method of claim 38, wherein the petroleum product is a grease.

41. The method of claim 38, wherein color is developed by base hydrolysis to produce a colored dianion.

* * * * *